US006041731A

United States Patent [19]

Willis

[11] Patent Number: 6,041,731

[45] Date of Patent: Mar. 28, 2000

[54] SELF-RIGHTING PLOW ANCHOR WITH FLOAT

[76] Inventor: John A. Willis, 3104 White Oak Rd., Raleigh, N.C. 27609

[21] Appl. No.: 09/300,126

[22] Filed: Apr. 27, 1999

[51] Int. Cl.[7] ..... B63B 21/32

[52] U.S. Cl. ..... 114/301

[58] Field of Search ..... 114/301, 308, 114/294, 303, 304, 297, 295

[56] References Cited

U.S. PATENT DOCUMENTS

| | | |
|---|---|---|
| 3,067,715 | 3/1962 | Billups . |
| 3,306,248 | 2/1967 | Austin . |
| 3,908,575 | 9/1975 | Giolfo . |
| 4,337,717 | 7/1982 | Gregory . |
| 4,834,015 | 5/1989 | Alpert . |
| 5,086,724 | 2/1992 | Schreiber . |
| 5,666,899 | 9/1997 | Andersen . |

*Primary Examiner*—S. Joseph Morano
*Assistant Examiner*—Patrick Craig Muldoon
*Attorney, Agent, or Firm*—Coats & Bennett, P.L.L.C.

[57] ABSTRACT

An anchor includes at least one plow-like fluke, a shank, and a float. The relative position of the float with respect to the center of gravity of the combined shank and fluke causes the anchor to assume a generally upright orientation quickly once the anchor is dropped in the water. One end of the shank is attached to the fluke and the float is attached to a rearward portion of the shank, with the float's center of buoyancy spaced away from the connection to the fluke. Upon being put in the water, the anchor quickly assumes a generally upright orientation, i.e., shank up and fluke tip down. Once in the generally upright orientation, the anchor may gently rock side to side with a pendulum-like action, with the tip of the fluke preferably being the lowest point of the anchor, during its descent to the bottom. When the anchor reaches a soft bottom, the tip of the fluke penetrates the bottom and the momentum of the anchor causes at least a portion of the fluke to bury into the bottom in a generally upright orientation. This setting of the anchor may be achieved in most or all situations without dragging the anchor along the bottom. The anchor is particularly adapted for watercraft where storage space is a concern and for shallow water watercraft.

25 Claims, 5 Drawing Sheets

SELF-RIGHTING PLOW ANCHOR WITH FLOAT

FIELD OF THE INVENTION

The present invention relates to the field of anchors for watercraft, and more particularly to a self-righting plow anchor that includes a float on a shank thereof to enable the anchor to quickly assume an upright orientation upon entering the water.

BACKGROUND OF THE INVENTION

Anchors for watercraft should ideally become set quickly once the anchor is dropped in the water. Numerous anchor designs have been proposed that attempt to address this problem, such as the design shown in U.S. Pat. No. 4,337,717. Many of these designs rely on some method of weighting the tip or tips of the anchor's fluke so as to promote a tip-first entry into the bottom. Other designs attempt to shape the fluke so that the anchor will right itself when the anchor is dragged along the bottom, and therefore properly dig into the bottom more quickly.

Applicant has discovered that quick setting of an anchor may be enhanced by causing the anchor to assume the proper orientation during descent, rather than relying on reorienting the anchor once it has landed. However, self-righting anchor designs proposed to date have proven inadequate, unduly complicated, or ill-suited for smaller anchors intended for use with smaller watercraft. In addition, the prior art designs are slow to assume the upright orientation and/or have proven unreliable. For instance, the modified Danforth type anchor of the patent to Austin, U.S. Pat. No. 3,306,248, is a complicated anchor having many parts. Likewise, the spade type anchors of the patents to Billups, U.S. Pat. No. 3,067,715 and to Schrieber, U.S. Pat. No. 5,068,724, are unduly complicated. It is believed that none of these anchors have achieved commercial success.

In addition, it has been discovered that plow type anchors work well in situations where the bottom is soft, such as with sandy or muddy bottoms. Plow type anchors are characterized by a fluke that includes a plurality of side surfaces, at least two of which that are at an angle with respect to one another, and a pointed forward tip. For instance, the main part of the fluke in such anchors may be an inverted V cross-section with a taper from back to front so as to appear roughly triangular when viewed from the side. An example of this design is the anchor known as the Delta Fast Set sold by Simpson & Lawrence of England.

Despite the numerous anchor designs in the prior art, there remains a need for a self-righting anchor that can very quickly assume the proper orientation once dropped in the water from any orientation. And there is a particular need for plow type anchors having such a self-righting action.

SUMMARY OF THE INVENTION

The anchor of the present invention includes, inter alia, at least one plow-like fluke, a shank, and a float. The relative position of the float with respect to the center of gravity of the combined shank and fluke causes the anchor to assume a generally upright orientation quickly once the anchor is dropped in the water.

One end of the shank is connected to the fluke, preferably by direct attachment along a longitudinal axis of the fluke. The connection between the fluke and the shank is preferably not a rigid connection, but is instead a somewhat loose connection that allows for small lateral displacements of the far end of the shank without the fluke being displaced. The float is attached to a rearward portion of the shank, with the float's center of buoyancy spaced away from the shank's connection to the fluke. Preferably, the float is shaped and sized to fit within the footprint of the fluke when viewed from above.

Upon being put in the water, the anchor of the present invention quickly assumes a generally upright orientation, i.e., shank up and fluke down. Thus, the anchor of the present invention is suitable for very shallow water situations. Once in the generally upright orientation, the anchor may gently rock side to side with a pendulum-like action, with the tip of the fluke preferably being the lowest point of the anchor, during its descent to the bottom. When the anchor reaches a soft bottom, the tip of the fluke penetrates the bottom and the momentum of the anchor causes at least a portion of the fluke to bury into the bottom in a generally upright orientation. This setting of the anchor may be achieved in most or all situations without dragging the anchor along the bottom.

Such an anchor is particularly adapted for shallow water operation, such as in a sound or the like, and the plow-like shape of the fluke is adapted for soft bottom applications. In addition, the anchor's simplicity of construction and effectiveness allows the anchor to be made economically in compact sizes while remaining effective. Thus, the present invention is particularly adapted for watercraft where storage space is a concern and for shallow water watercraft.

DETAILED DESCRIPTION

Figure 1:
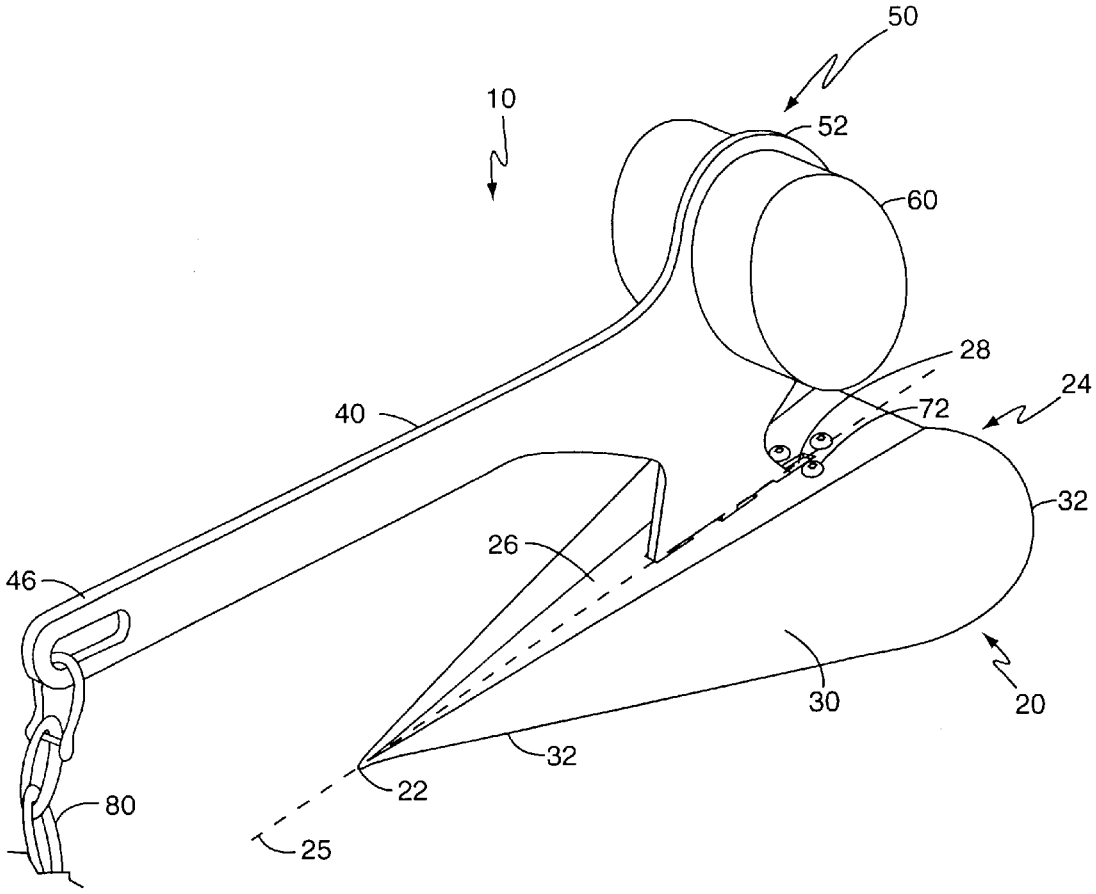
FIG. 1 is a perspective view of one embodiment of an assembled anchor according to the present invention.
Figure 2:
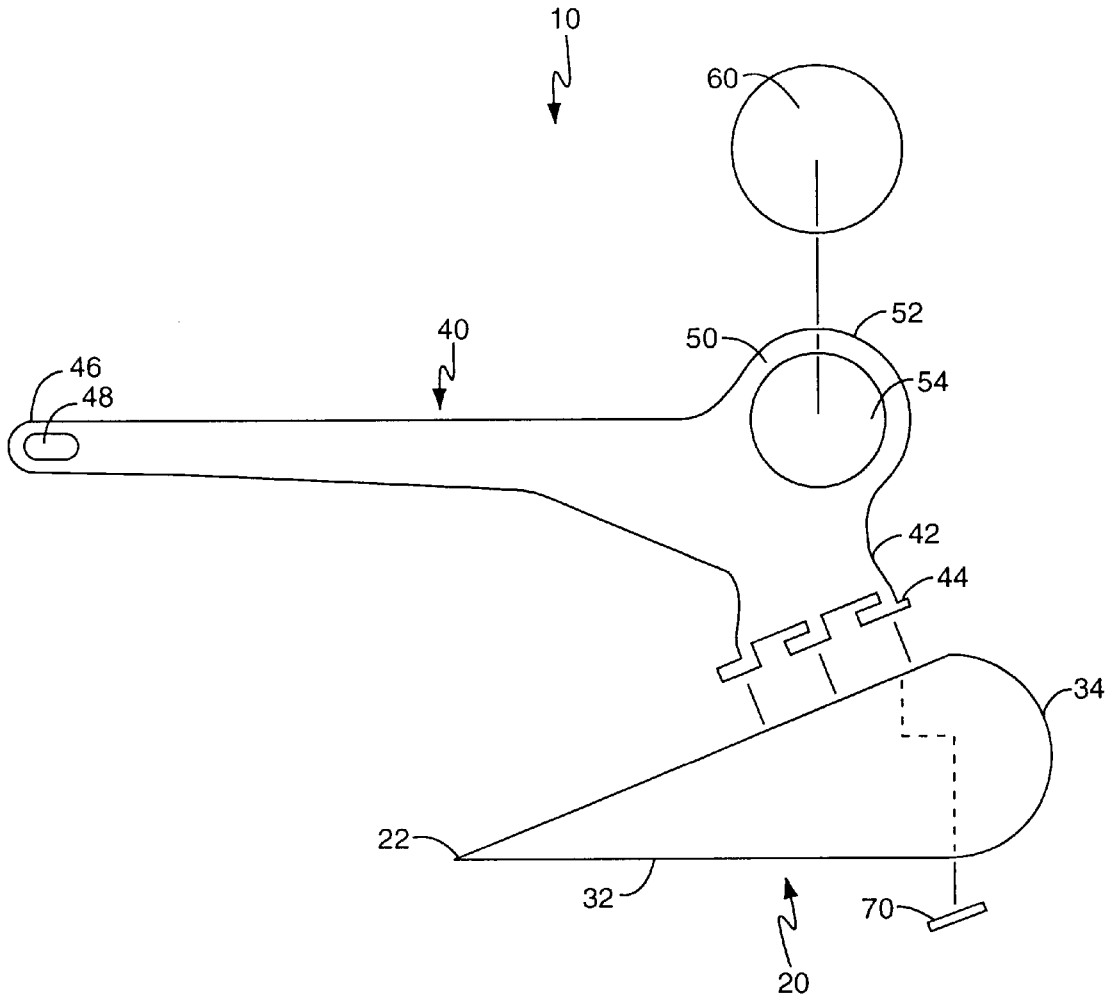
FIG. 2 is an exploded view of the anchor of FIG. 1 without the float.
Figure 3:
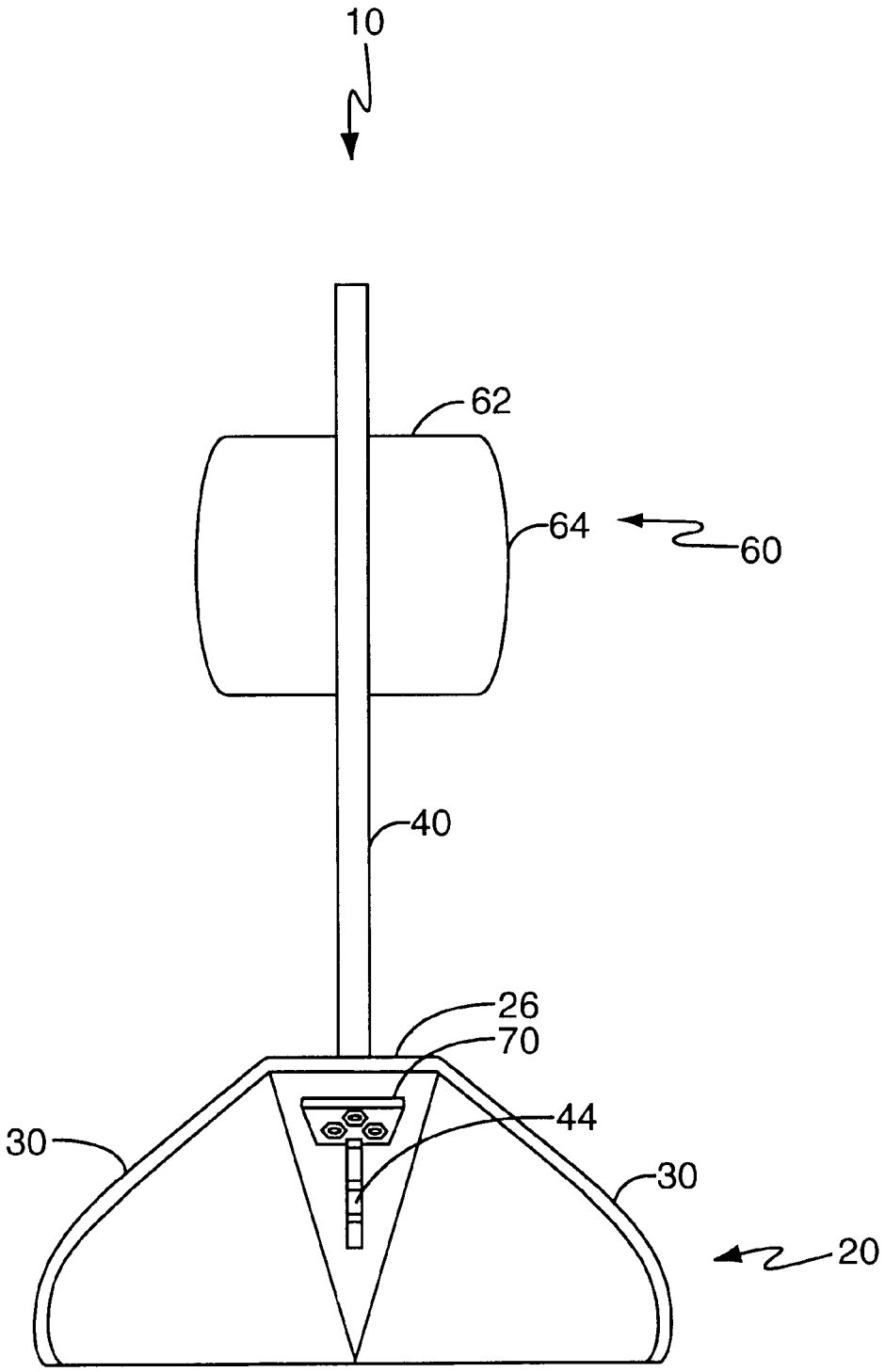
FIG. 3 is a rear underside view of the anchor of FIG. 1.

Referring to FIGS. 1–3, the anchor 10 of the present invention includes a fluke 20, a shank 40, and a float 60. The fluke 20 in FIG. 1 has a pointed front tip 22 and a broad tail 24. Running generally along the centerline of the fluke 20, from tail 24 to tip 22, is a longitudinal axis 25. The fluke 20 includes a pair of side surfaces 30, referred to herein as wings, joined by a third surface, referred to herein as a bridging surface 26. The wing surfaces 30 are generally triangular in shape with a generally straight lower edge 32 and a curved rear edge 34. The two wings 30 of FIG. 1 are of the same general shape, are disposed symmetrically about the longitudinal axis 25, and are canted with respect to one another. The wings 30 preferably meet at, and help form, the pointed tip 22 of the fluke 20. In contrast to many prior art anchors, in preferred embodiments of the fluke 20 there is no additional weighting at or near the tip 22, so as to lessen the overall weight of the anchor 10.

Between the two wings 30 is the optional bridging surface 26, which is also generally triangular in shape. Located in a middle portion of the bridging surface 26 are a plurality if mounting slots 28 that are preferably rectangular in shape. Also included on the bridging surface 26, near the rearmost mounting slot 28, are a plurality of holes for screws 72 that mount the lock plate 70 to the fluke 20 as described below.

The fluke 20 is preferably made from a single piece of metallic material, such as sheet steel, galvanized steel, stainless steel, aluminum, or other material suitable for aquatic environments. Alternatively, the fluke 20 may be formed from distinct pieces that are fastened or otherwise secured together, such as by welding.

The shank 40 is a generally elongate member preferably having three sections, a base 42, a middle 50, and a head 46, as may easily be seen in FIG. 2. The base 42 includes a plurality of downwardly extending flanges 44 that are preferably L-shaped. The flanges 44 should be dimensioned so as to be able to be inserted through the mounting slots 28 on the fluke 20. The head 46 is generally elongate and includes a slot 48 for connecting to an anchor line 80. Between the head 46 and the base 42 is a middle section 50. This middle section 50 includes a protrusion 52 that extends rearwardly away from the head 46 and that includes a circular mounting hole 54. The shank 40 may be made from similar materials as the fluke 20, but is preferably made from a less dense material so that the majority of the mass of the combined shank 40 and fluke 20 resides in the fluke 20.

The float 60 may take a wide variety of shapes, but the float 60 is preferably generally cylindrical in shape with closed hemispherical ends 64. The float 60 may be made from any suitably buoyant material, such as foamed plastic or the like. The material should be durable and resistant to UV damage. In some embodiments, the float 60 may be constructed from common heavy duty PVC piping materials. For instance, two end caps may be joined to a short section of PVC pipe to form a generally cylindrical body, with or without a center peripheral groove on the center portion of the outer surface 62. Obviously, the interior portion of the float 60 should be water-tight for buoyancy. Further, it is plainly preferable that the corresponding portions of the float 60 and the mounting hole 54 of the shank 40 have the same shape.

To assemble the anchor 10, the float 60 is joined to the shank 40. If the float 60 is unitary, such as a compressible foam, the float 60 may be inserted into the mounting hole 54 in the middle section 50 of the shank 40. The float 60 should be located so that it will provide approximately equal buoyancy to both left and right sides of the shank 40. In one preferred embodiment, using the float 60 made from PVC pipe material, one end cap may be joined to a short section of PVC pipe using conventional means. The pipe section should be small enough to just fit within the mounting hole 54 and the end cap should have an outer diameter just larger than the mounting hole 54. This partially assembled float 60 is then inserted into the mounting hole 54, with the pipe section fitting through the mounting hole 54. Thereafter, the other end cap may be added. With such a float 60, the shank 40 will in effect bisect the outer surface 62 of the float 60 without penetrating the interior chamber of the float 60.

The shank 40, with the float 60 attached thereto, is then mated to the fluke 20. To do so, the flanges 44 of the shank 40 are inserted through the mounting slots 28 on the fluke 20 and then the shank 40 is pulled forward such that the L-shaped flanges 44 engage the underside of the spaces between the mounting slots 28. The shank 40 should be oriented generally along the longitudinal axis 25 of the fluke 20 with the head 46 of the shank 40 being closer to the tip 22 than the tail 24 of the fluke 20. To hold the shank 40 in place, a lock plate arrangement may be used, as shown in FIG. 3. A lock plate 70 may be added to the underside of the fluke 20 so that a portion of the lock plate 70 extends into the space directly below one of the mounting slots 28 and up against a rear edge of a flange 44. The lock plate 70 may then be secured in place by suitable screws 72 passing through the fluke 20 and the lock plate 70.

Of course, the sequence of assembly described above is but one of a variety of methods of making an anchor 10 according to the present invention. The sequence and inclusion of certain steps is for illustrative purposes only and is specifically not intended to be limiting as to the method of manufacture or the ultimate structure achieved.

With the shank 40 connected to the fluke 20, the combined assembly will have a center of gravity. The float 60 should be rearward of this center of gravity, but forward of the tail 24 of the fluke 20. Note, however, that the entire float 60 should preferably fit within the footprint of the fluke 20 when viewed from above.

To use the anchor 10, a suitable anchor line or chain 80, is attached to the anchor 10 via the slot 48 on the end of the shank 40. Thereafter, the anchor 10 is dropped, tossed, hurled, or otherwise released into the water. Importantly, the anchor 10 of the present invention does not need to be in any particular orientation when introduced into the water. Once in the water, the anchor 10 will begin to sink through the water until it reaches the ground under the water. Because this ground may be sand, rock, mud, and may be under the sea, a lake, a river, a bay, or the like, the generic term "bottom" will be used for the balance of this description. While the bottom may be relatively hard, the present anchor 10 is particularly adapted for soft bottoms, such as sandy and/or muddy bottoms.

Upon being put in the water, the anchor 10 of the present invention quickly assumes a generally upright orientation, i.e., shank 40 up and fluke 22 down. This action is believed to be due to the location of the float 60 relative to the center of gravity of the anchor 10 and the tip 22 of the fluke 20. By quickly, it is meant that the anchor 10 assumes the generally upright orientation within a vertical distance of five times the overall height of the anchor 10 or less, after being released at the surface of the water. Thus, the anchor 10 of the present invention is suitable for very shallow water situations. Once in the generally upright orientation, the anchor 10 will likely rock side to side in a pendulum-like action during its descent to the bottom. The point of rotation should be the center of buoyancy of the float 60. The overall orientation is preferably such that the tip 22 of the fluke 20 is the lowest point of the anchor 10 during descent. This orientation may be achieved by placing the float 60 rearward and upward from the center of gravity of the anchor 10, with the tip 22 on the opposite side of the center of gravity, as shown in FIG. 1.

When the anchor 10 reaches a soft bottom, the tip 22 of the fluke 20 will penetrate the bottom and the momentum of the anchor 10 will cause at least a portion of the fluke 20 to bury into the bottom. Preferably, the entire fluke 20 is buried, so that maximum resistance to movement may be achieved. When buried as described, the anchor 10 resists any forward force applied via the anchor line 80. This setting of the anchor 10 may be achieved in most or all situations without dragging the anchor 10 along the bottom.

It should be noted that watercraft tend to move somewhat relative to the anchor 10 while anchored. In preferred embodiments, the present anchor 10 allows for small changes in the lateral angular relationship between the watercraft and the anchor 10 by allowing for small amounts of lateral movement at the connection between the shank 40 and the fluke 20. That is, the shank 40 is preferably not rigidly attached to the fluke 20, but is instead preferably connected though a joint having a small amount of built-in clearance.

To remove the anchor 10, the user in the watercraft pulls in the anchor line 80 until the watercraft is approximately directly over the anchor 10. By pulling on the anchor line 80 at this point, the end of the shank 40 will be pulled upwardly, thereby rotating the fluke 20 so that the tip 22 is no longer buried in the bottom, or at least pointed upwardly out of the bottom. The curved portions 34 of the wings 30 that help form the tail 24 of the fluke 20 should facilitate this rotational movement. Thereafter, the anchor 10 may simply be hauled aboard the watercraft in the customary fashion.

In the description above, the shank 40 was connected to the fluke 20 using an arrangement including a lock plate 70. However, such an arrangement is not required. Indeed, the shank 40 may be joined to the fluke 20 in any manner known in the art, including by direct screwing, welding, or the like. Further, while not preferred due to the weight distribution aspects, the shank 40 may be formed integrally with the fluke 20, such as by casting.

In addition, the fluke 20 above has been described as having two wings 30 and a central bridging surface 26. However, such a fluke 20 is not required. Instead, the fluke 20 is only required to have two side surfaces 30, one on each side of the longitudinal axis 25, with the side surfaces 30 being disposed at an angle relative to one another.

An embodiment of the anchor 10 similar to that shown in FIG. 1 has been built. The fluke 20 was made from ⅛ inch thick 304 stainless steel, had a tail 24 to tip 22 dimension of approximately 8 ½ inches, a height at the tail 24 of approximately three inches, an overall width at the tail 24 of approximately six inches. The shank 40 was made from ¼ inch thick aluminum, had an overall length of approximately twelve inches, three L-shaped flanges 44 of approximately ¼ inch thickness (with the rearmost flange 44 having rearward facing portion of approximately ¼ inch to engage the lock plate 70), and extended approximately normal to the bridging surface 26 of the fluke 20 when assembled. The float 60 was assembled from two inch diameter "SCH 40 PVC I" pipe available from Lasco, including two endcaps and a short pipe section. The float 60 was directly attached to the shank 40, with the center of the float 60 located approximately 3 ½ inches above the fluke 20, and bisected by the shank 40. The overall height of the anchor 10 was approximately 7 ¼ inches. Such an anchor 10 was tested and assumed a generally upright orientation within a vertical distance of approximately two and one half feet or less after being released at the surface of the water in an upside down orientation.

Figure 4:
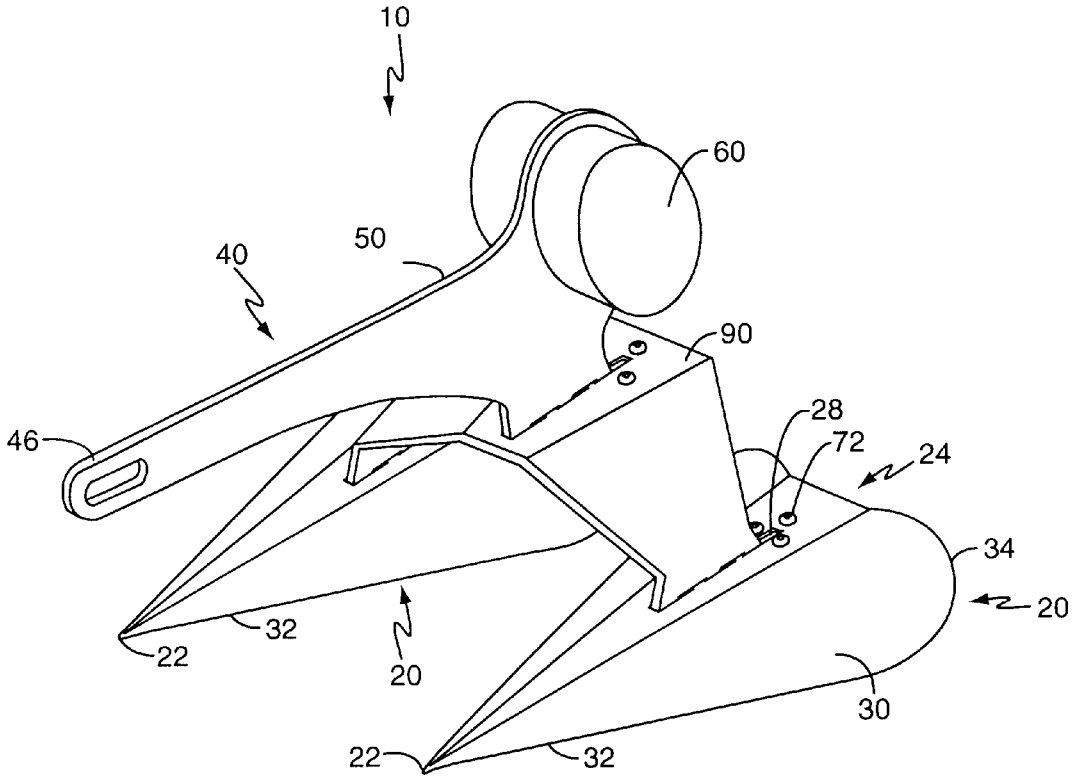
FIG. 4 is a perspective view of another embodiment of an assembled anchor according to the present invention having two flukes.
Figure 5:
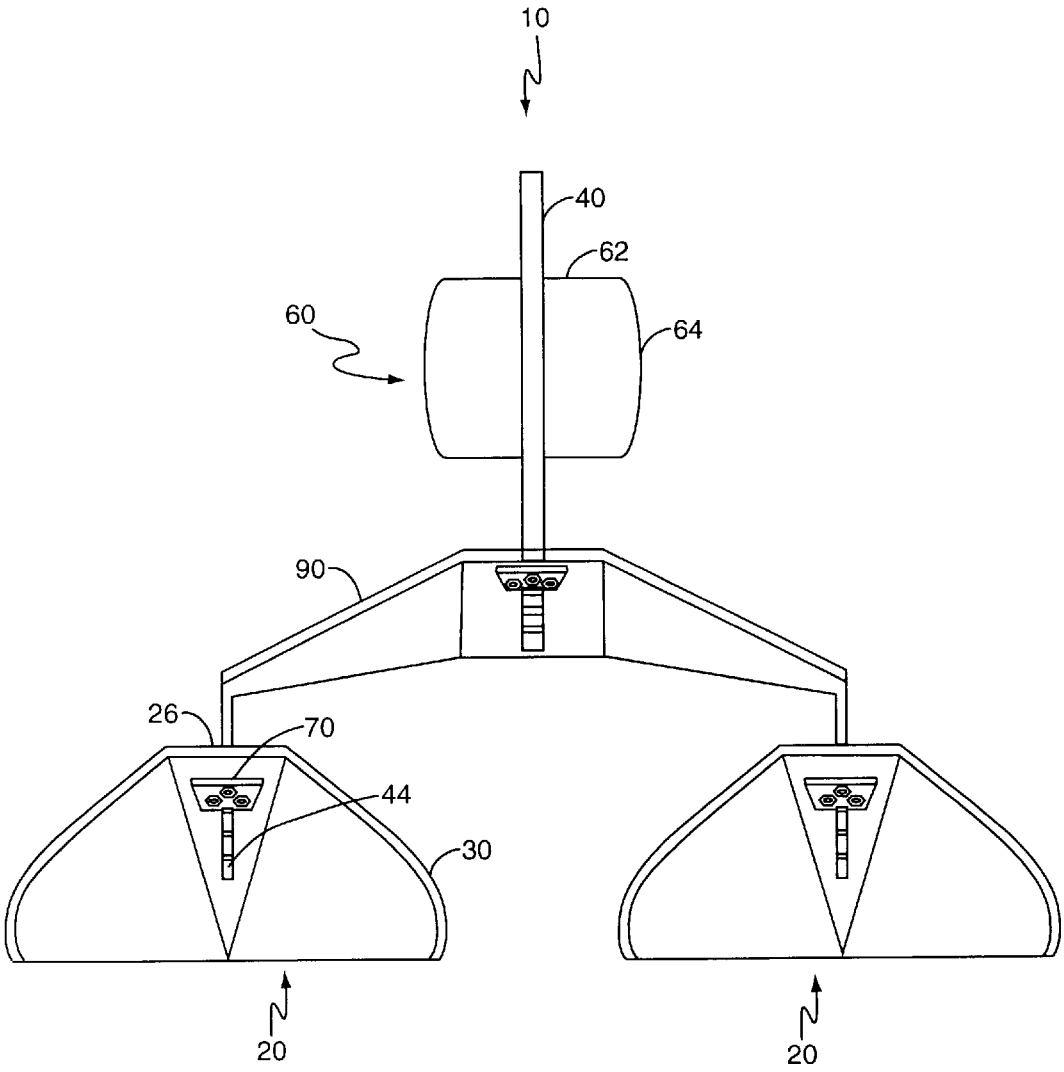
FIG. 5 is a rear elevational view of the anchor of FIG. 4.

In other embodiments, the anchor 10 may include a plurality of flukes 20. For example, the anchor 10 shown in FIG. 4 and FIG. 5 includes a pair of flukes 20. These flukes 20 are interconnected by a generally U-shaped bracket 90. The bracket 90 in turn mates with the shank 40, preferably using a flange and lock plate arrangement similar to the joint between the shank 40 and fluke 20 of FIG. 1. As shown in FIGS. 4 and 5, the shank 40 is disposed between the two flukes 20 such that the buoyant center of the float 60 is both above the longitudinal axes 25 of the flukes 20 and located between the axes 25 when viewed from above. In fact, for the embodiment shown, the float 60 is located directly above the center of gravity of the combined fluke-shank assembly. Of course, the float 60 may be located elsewhere, but such a central position is believed to be most advantageous. Further, while only two flukes 20 are shown in FIG. 4, the anchor 10 may include more flukes 20, preferably in a regular geometric configuration with all the lower edges 32 of the respective flukes 20 lying in a common plane.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An anchor, comprising:

a) at least one fluke having at least a tip on a forward section thereof, a tail on a rearward section thereof, a longitudinal axis running from a central portion of said tail to a central portion of said tip, and at least first and second wing surfaces disposed on opposing sides of said longitudinal axis and canted with respect to each other;

b) a shank connected to said fluke on a dorsal side thereof and extending away therefrom generally parallel to said longitudinal axis;

c) a float attached to said shank at a position spaced away from said fluke and having a buoyant center, said buoyant center disposed above said longitudinal axis; and d) wherein said float causes the anchor to quickly assume a generally upright position when the anchor is descending through water after being released from any original starting orientation at the water's surface.

2. The anchor of claim 1 wherein the buoyant center of said float is disposed closer to said tail than said tip.

3. The anchor of claim 1 wherein said float does not extend laterally beyond said fluke when viewed from above.

4. The anchor of claim 1 wherein said float is directly attached to said shank.

5. The anchor of claim 1 wherein said float has an outer surface that is generally cylindrical in shape and generally bisected by said shank.

6. The anchor of claim 1 wherein said fluke further includes a third generally flat surface disposed between said first and second wing surfaces and wherein said shank connects to said fluke via said third surface.

7. The anchor of claim 1 wherein the anchor includes not more than one fluke.

8. The anchor of claim 1 wherein said fluke includes a single generally pointed front tip.

9. The anchor of claim 1 wherein said fluke is not additionally weighted proximate said tip other than by the weight of the material forming said fluke.

10. The anchor of claim 1 wherein said float remains in a fixed position relative to said shank and wherein said buoyant center of said float is disposed not farther forward than the center of gravity of said anchor.

11. The anchor of claim 1 wherein said float causes said anchor to remain generally upright, once righted, for the remaining duration of descent through said water.

12. The anchor of claim 1 wherein said fluke includes a generally pointed tip and wherein said tip automatically penetrates the ground under the water upon initial contact with said ground without having to be additionally displaced relative to said ground by pulling on said shank.

13. The anchor of claim 1 wherein said float causes said anchor, from any initial orientation, to assume a generally upright orientation within three feet of descent when dropped from a height of six feet or less above the water's surface.

14. The anchor of claim 1 wherein said shank includes a base proximate to said fluke and a head a distance from said fluke and wherein said shank is connected to said fluke via a loose connection wherein said head may move ½ inch or less laterally with respect to said longitudinal axis without causing said fluke to move laterally.

15. The anchor of claim 1 wherein said buoyant center of said float is disposed directly above said longitudinal axis.

16. The anchor of claim 1 further including a plurality of said flukes.

17. The anchor of claim 16 wherein said buoyant center of said float is further disposed between the said flukes when viewed from above.

18. A plow anchor, comprising:

a) at least one plow-like fluke having at least a generally pointed front tip, a tail, a longitudinal axis running from said tail to said tip, and at least first and second generally flat surfaces disposed on opposing sides of said longitudinal axis and angled with respect to each other, said fluke not additionally weighted proximate said tip other than by the weight of the material forming said fluke;

b) a shank connected to said fluke on a dorsal side thereof and extending away therefrom generally along said longitudinal axis;

c) a float attached to said shank at a position spaced away from said fluke and having a buoyant center, said buoyant center disposed above said longitudinal axis and closer to said tail than said tip; said float having an outer surface that is generally bisected by said shank; and d) wherein said float causes the anchor to quickly assume a generally upright position when the anchor is descending through water after being released from any original starting orientation at the water's surface; and wherein said float causes said anchor to remain generally upright, once righted, for the remaining duration of descent through said water.

19. The anchor of claim 18 wherein said fluke includes a generally pointed tip and wherein said tip automatically penetrates the ground under the water upon initial contact with said ground without having to be additionally displaced relative to said ground by pulling on said shank.

20. The anchor of claim 19 wherein, when said ground is deep sand, the anchor may be pulled forward no more than twice the length of said fluke before the anchor becomes set.

21. The anchor of claim 18 wherein said float is directly attached to said shank.

22. A plow anchor, comprising:

a) at least one plow-like fluke having at least a generally pointed front tip, a tail, a longitudinal axis running from said tail to said tip, and at least first and second generally flat surfaces disposed on opposing sides of said longitudinal axis and angled with respect to each other; said fluke further including a third generally flat surface disposed between said first and second flat surfaces, said fluke not additionally weighted proximate said tip other than by weight of the material forming said fluke;

b) a shank connected to said fluke via said third surface on a dorsal side thereof and extending away therefrom generally along, but above, said longitudinal axis;

c) a float directly attached to said shank at a position spaced away from said fluke and having a buoyant center, said buoyant center disposed above said longitudinal axis and closer to said tail than said tip; said float having an outer surface that is generally bisected by said shank;

d) wherein said float does not extend laterally beyond said fluke when viewed from above; and e) wherein said float causes the anchor to quickly assume a generally upright position when the anchor is descending through water after being released from any original starting orientation at the water's surface; and wherein said float causes said anchor to remain generally upright, once righted, for the remaining duration of descent through said water.

23. The anchor of claim 22 wherein, when said ground is deep sand, said anchor penetrates the ground under the water upon initial contact with said ground and wherein said anchor may be pulled forward not more than two feet before the anchor becomes set in said ground.

24. The anchor of claim 22 wherein, when said ground is deep sand, said tip automatically penetrates the ground under the water upon initial contact with said ground without having to be additionally displaced relative to said ground by pulling on said shank.

25. The anchor of claim 22 further including a plurality of said flukes connected to said shank and wherein said buoyant center of said float is further disposed between at least two of said flukes when viewed from above.

* * * * *